US005235321A

United States Patent [19]

Rowan et al.

[11] Patent Number: 5,235,321

[45] Date of Patent: Aug. 10, 1993

[54] SKI ALARM SYSTEM

[76] Inventors: David Rowan; Daniel M. Jayson, both of c/o Ski Recovery Systems, 98 Commercial Road, London E1 1NU, Great Britain

[21] Appl. No.: 741,188

[22] Filed: Jul. 30, 1991

Related U.S. Application Data

[63] Continuation of Ser. No. 343,139, Apr. 25, 1989, abandoned.

[51] Int. Cl.[5] ..... G08B 13/14; G08B 23/00

[52] U.S. Cl. ..... 340/571; 200/DIG. 29; 340/529; 340/573; 340/521

[58] Field of Search ..... 340/571, 573, 689, 521, 340/529, 309.15; 200/DIG. 29, 61.45 R; 324/701, 706

[56] References Cited

U.S. PATENT DOCUMENTS

| | | | |
|---|---|---|---|
| 3,988,724 | 10/1976 | Anderson | 340/572 |
| 4,023,157 | 5/1977 | Miller | 340/571 |
| 4,279,433 | 7/1981 | Petaja | 340/573 |
| 4,450,437 | 5/1984 | Ho | 340/573 |
| 4,535,322 | 8/1985 | Yeski | 340/571 |
| 4,603,328 | 7/1986 | Larson | 340/666 |
| 4,833,456 | 5/1989 | Heller | 340/571 |
| 4,835,523 | 5/1989 | Pruett | 340/571 |
| 4,855,720 | 8/1989 | Donovan | 361/172 |

*Primary Examiner*—Thomas Mullen

*Attorney, Agent, or Firm*—Wenderoth, Lind & Ponack

[57] ABSTRACT

An alarm unit for a ski has a battery powered circuit which energizes an audible alarm in response to the output from a movement detector on the indication of absence of movement for a predetermined time. This allows a buried ski or a buried skier to be detected. A remotely controlled mode switch enables the unit to be switched to a theft mode in which the alarm is energized on detection of movement by the movement responsive unit.

7 Claims, 5 Drawing Sheets

SKI ALARM SYSTEM

This application is a continuation of now abandoned application Ser. No. 07/343,139 filed on Apr. 25, 1989;

BACKGROUND AND SUMMARY OF THE INVENTION

The invention relates to a ski alarm system and provides an alarm unit for a ski which allows the ski to be detected when buried in snow. Such a unit has use in detecting the whereabouts of a skier who may have been buried in an accident and also in finding lost skis. A preferred feature of the invention is the additional use of the unit in detecting attempted theft of skis.

According to the invention there is provided an alarm unit for ski comprising a sounder for emitting an audible alarm signal. A battery powered circuit connected to energize the sounder. A movement responsive unit is connected to the circuit, the circuit including a timer and being arranged to activate the sounder when the movement responsive unit has given no output representative of movement for a predetermined time.

The alarm unit may, instead of being designed as an accessory to be fixed to a ski, be incorporated in the ski binding.

There have been proposed hitherto arrangements in which a ski alarm is activated on removal of the ski from the boot or on automatic actuation of the ski brake. Unlike the present invention, such systems are of no use in detecting buried skiers who have retained their skis.

Preferably the circuit has at least two modes to which it may be set, namely a ski mode in which, as described above, lack of movement is caused to energize the sounder, and a theft mode in which the converse is true, and the sounder is energized on detection of movement by the movement-responsive unit.

Preferably the circuit has additionally a test mode in which the alarm functions may be tested and a standby mode in which the circuit is clear to be set to one of the other modes. Mode setting may be accomplished by mechanical or magnetic reed switches associated with the alarm unit. Preferably, however, a remote control unit is provided. The remote control unit may effect control by audio signals, perhaps of ultrasonic frequencies or by radio control. Preferably, however, the remote control unit is an infra-red transmitter which issues coded infra-red signals to a receiver unit incorporated in the alarm unit.

Preferably the movement responsive unit comprises a housing with walls, internal electrodes on different walls of the housing and a number of discrete electrically conductive members in the housing which are free to move and which rest in contact with each other and with the electrodes to form a conductive bridge between the electrodes, movement of the members being effective to change the resistance presented by the members between the electrodes. The members are preferably metal balls. The housing may be oil-filled.

The sounder is preferably a piezo-electric unit. Extensive experiments have established that in typical operating conditions there is an optimum frequency range which, for a given power output, offers the best sound detection and position location characteristics. This frequency range is between 2000 and 4000 Hz.

BRIEF DESCRIPTION OF THE DRAWINGS

The invention will further be described with reference to the accompanying drawings, in which.

DESCRIPTION OF THE PREFERRED EMBODIMENT

Figure 1:
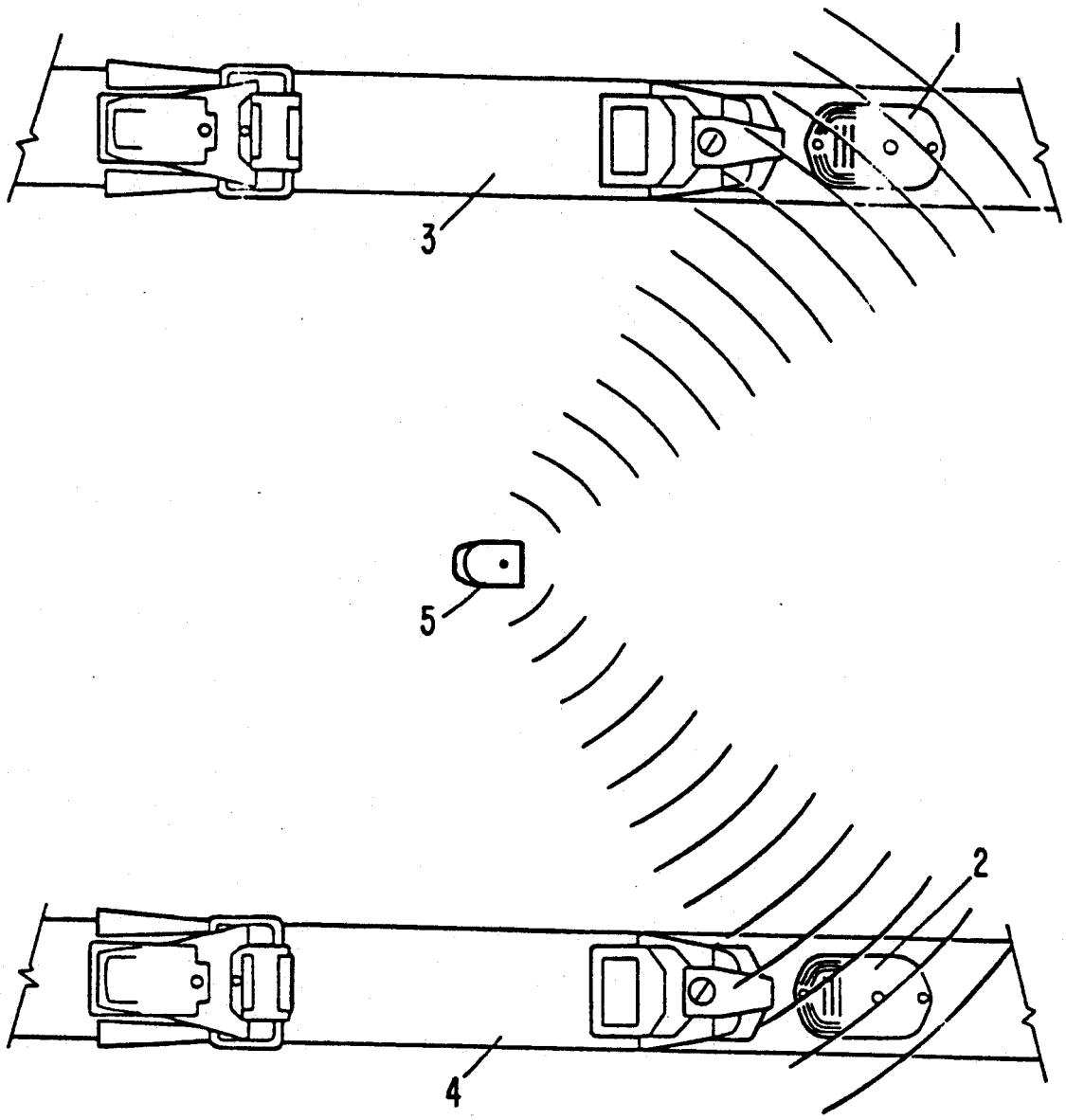
FIG. 1 is a schematic diagram of a pair of skis fitted with alarm units in accordance with the invention, together with a control unit therefor.

Referring to FIG. 1 the system comprises alarm units 1 and 2 mounted on respective skis 3 and 4. A control unit 5 is hand held and issues infra-red signals to control the mode settings of the alarm units.

Figure 2:
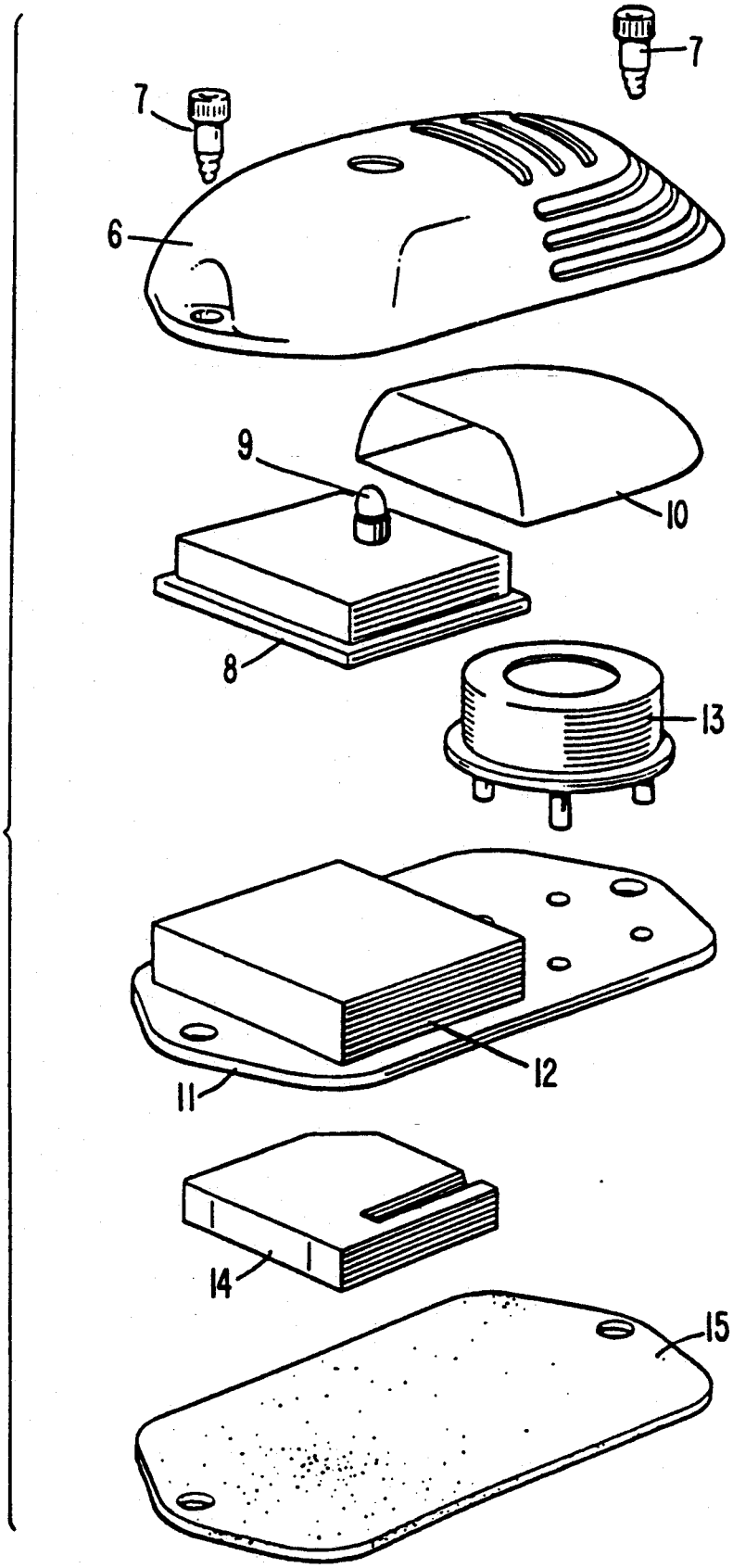
FIG. 2 is an exploded view of the unit for attachment to a ski.

FIG. 2 shows an alarm unit comprising a cover 6, mounting screws 7, a printed circuit board (pcb) assembly 8 with a light emitting diode 9, an acoustically transparent cover 10, a base plate 11 which carries a battery housing/pcb mount 12 and a piezo-electric sounder 13. Within the pcb assembly 8 is mounted a motion detector (not shown separately). This is described in detail with reference to FIG. 4. A suitable commercial motion detector is made by Kelvin Impex under the designation MAC 702. This kind of detector is found by experiment to be superior to a mercury switch or trembler switch. The battery is shown at 14 and a water-proof gasket at 15.

Figure 3:
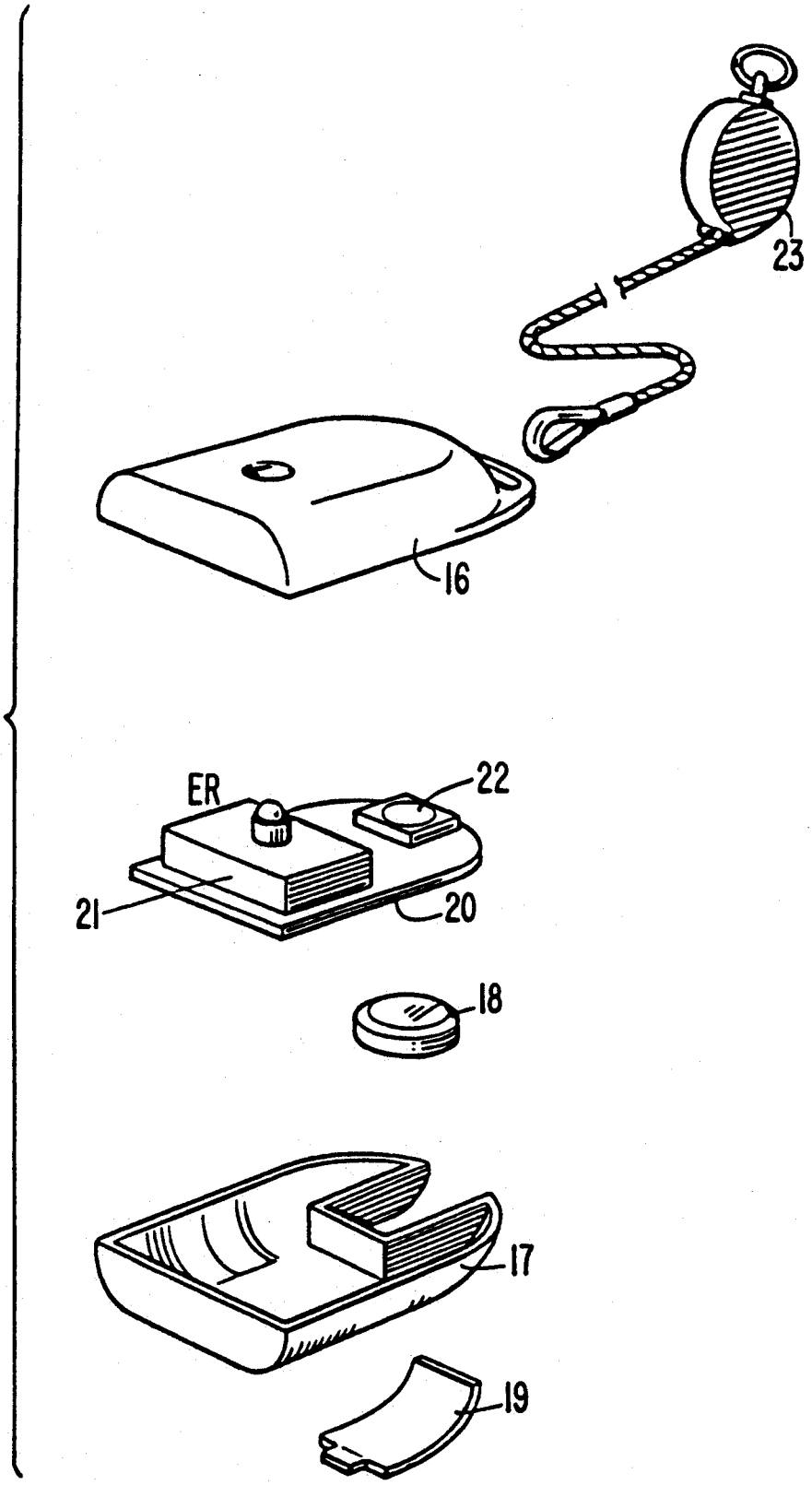
FIG. 3 is an exploded view of the control unit.

FIG. 3 shows the infra-red control unit 5 comprising an upper case 16, and a lower case 17, a battery 18, a battery cover 19, and a printed circuit board assembly 20 having an infra-red transmitter 21 and an actuating switch 22. A spring-loaded reel has a clip-on attachment 23 to allow the unit to be clipped to clothing.

In order to combat the severe environment under which the system must operate, the overall philosophy and design concept considered the following:

Ability to withstand vibration;

Ability to withstand extremes of temperature;

Imperviousness to moisture;

Small size, weight and low profile for mounting on skis; and

Low power consumption for minimum battery size.

To achieve these goals, advantage has been taken of the latest electronics technology, namely ASIC and S M D technology.

ASIC (Application Specific Integrated Circuits) allows the custom manufacture of complex circuitry in a small micro processor which is designed solely for the intended function, combining both digital and analog systems. The result is a highly efficient unit which acts as the onboard control center for both the ski based units and the remote control unit.

S M D (Surface Mount Device) refers to the way in which the printed circuit board is manufactured. Instead of conventional leaded components soldered onto a circuit board, S M D places the components directly onto the board which are then soldered in an infra red oven and subsequently protectively coated. This concept results in a small P C B which is insensitive to moisture and vibration, is compact, and very economical to manufacture.

Figure 4:
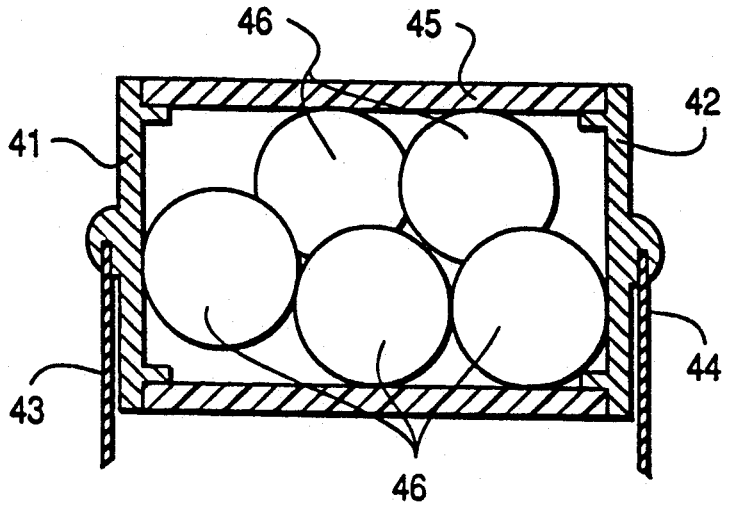
FIG. 4 is a schematic cross-sectional view of the motion detector for the alarm unit.

Referring now to FIG. 4 the motion detector is shown comprising a cylindrical housing having two metal end walls 41, 42 which constitute electrodes. Leads 43, 44 connect the detector to the alarm circuit. The end walls are separated by an insulating cylindrical wall 45. Within the housing is a collection of steel balls 46 which rest on each other and against the end walls, thereby making bridging contact between the end walls. When the housing is vibrated or shaken the contacts made by the balls are disturbed and there is a consequent electrical resistance change between the end walls. This is detected as a movement signal by the alarm circuit.

Figure 5:
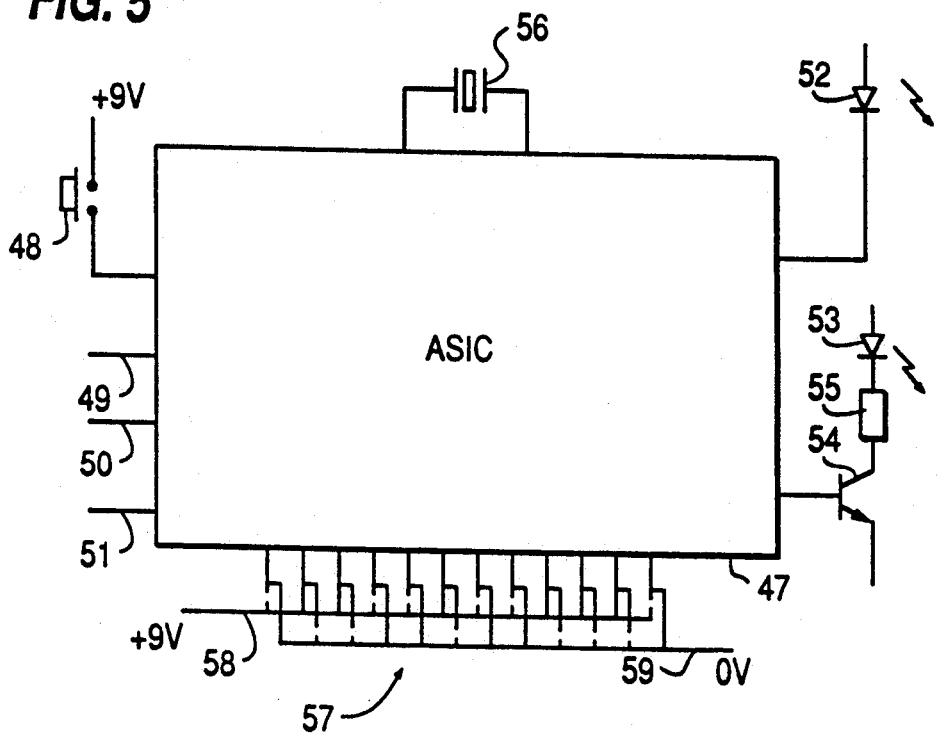
FIG. 5 is a block circuit diagram of the remote control infra-red transmitter.

Referring now to FIG. 5 there is shown the circuit of the controller 5. This comprises an application specific integrated circuit (ASIC) 47 which has external components including a battery (not shown) with a manual 'on' switch 48. Two test input lines 49, 50 connected to receive manually controllable inputs are effective to test the transmitter. A test output 51 is available to allow analysis of the test results.

A status LED 52 is provided to indicate the status of the transmitter. An infra-red emitter 53 with associated driving transistor 54 and resistor 55 is provided to give a modulated pulsed output. Pulse timing is governed by a 32 kHz crystal 56 and the particular modulation is determined by a code track 57. This is constituted by a set of conductive tracks connecting both a 9 volt line 58 and an earth line 59 to twelve output pins of the ASIC. The operative code for the transmitter is determined by breaking the track to each pin either from the line 58 or from the line 59. Thus, a particular set of voltages is applied as a binary parallel number to the twelve pins. This code corresponds to the same code set in the associated receiver, thereby ensuring that the likelihood of interference with other transmitter/receiver sets is remote.

Figure 6:
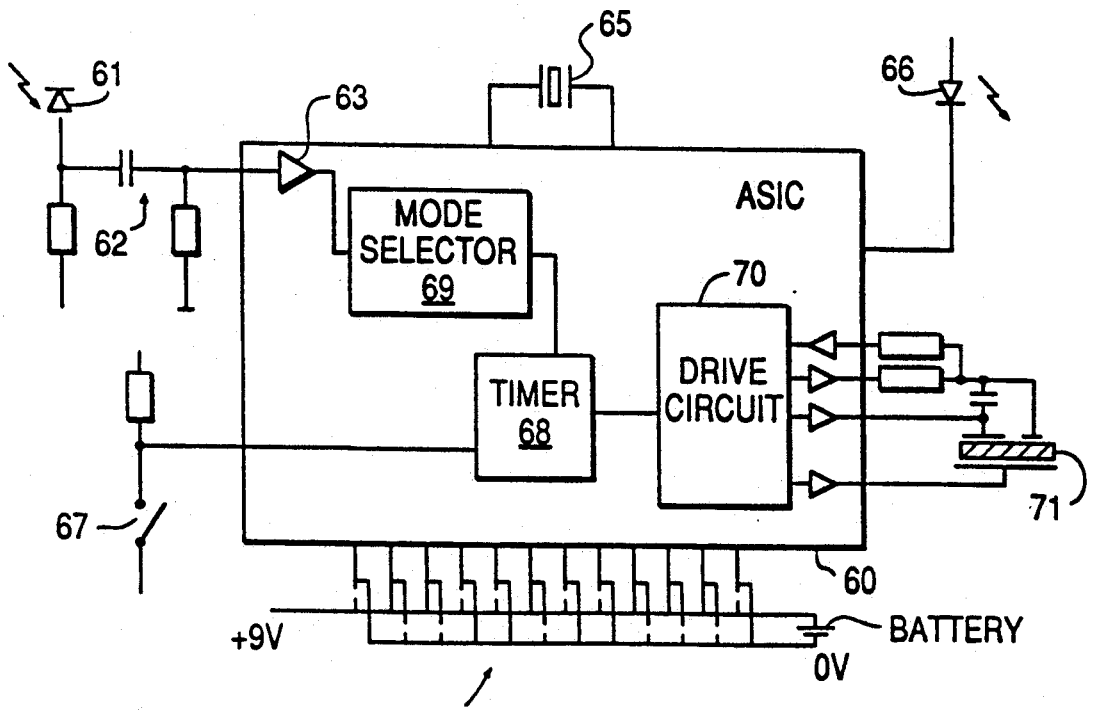
FIG. 6 is a block circuit diagram of the infra-red receiver.

Referring now to FIG. 6 there is shown a block diagram of the receiver in the alarm unit. This comprises an ASIC 60 with external components including an infra-red receiver diode 61 and associated RC network 62. Pulses from the diode 61 are applied to an operational amplifier 63 forming part of the ASIC. A code track 64 of the same nature and configuration as track 57 of the transmitter is provided. A 32 kHz crystal 65 provides clock pulses and an LED 66 indicates the status of the receiver.

The motion detector is represented at 67 in FIG. 6 and provides an input to a timer circuit 68 in the ASIC. A mode selector unit 69 in the ASIC responds to inputs decoded from the diode 61 and according to the mode determined by the transmitted pulses controls the timer circuit. Thus, in the ski mode the timer circuit is controlled to be reset by input from the motion detector. If a predetermined time is allowed to elapse without a reset from the motion detector then the timer circuit activates a drive circuit 70 in the ASIC which causes a piezo-electric sounder 71 to emit a warbling alarm tone. In the theft mode the timer circuit is controlled to activate the drive circuit if successive movements are detected within a predetermined time.

Figure 7:
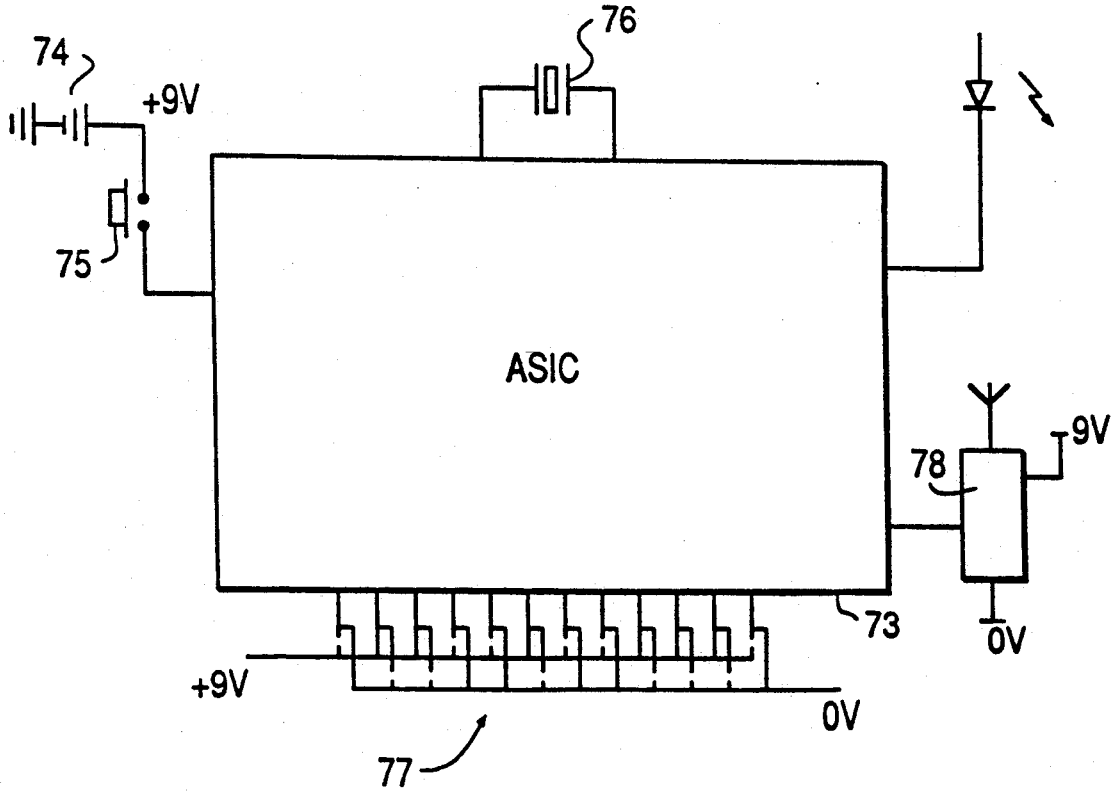
FIG. 7 is a block circuit diagram of an alternative remote control transmitter for radio control.

Turning now to FIG. 7 there is shown a transmitter for an alternative system of control. Here the transmitter is a radio transmitter instead of an infra-red transmitter. An ASIC 73 is powered by a battery 74 via a manual switch 75. A 32 kHz crystal 76 gives clock pulses and a code track 77 of the kind described above provides a code for pairing a transmitter and receiver. Output from the ASIC modulates a 149 MHz radio transmitter 78. It will be understood that a complementary radio receiver is provided on each ski to respond to the transmitter and perform the functions outlined above for the infra-red receiver.

In order to ensure that the alarm function of the units is audible under operational conditions extensive field test to define the best sound frequency range for a snow covered environment have been conducted. The relationship between sound frequency (Hz) and sound level (Db) is a complex issue especially when trying to weight the levels against human responses. Different frequencies perform more effectively under different conditions. Thus by plotting Hz against Db in different snow coverage thicknesses it is possible to define the optimum frequency which penetrates snow, is audible at an extended distance, and provides superior directional definition. It has been established that a frequency range of between 2000 to 4000 Hz meets these criteria. Preferably, the audible alarm is at a particular frequency in the range 2000 Hz to 4000 Hz and the sound in intermittent, typically one second on and one second off. This conserves battery power compared with a system in which the sound is continuous. An alternative arrangement is to provide that the alarm emits a "warbling" type resonse between the two frequency extremes. This gives maximum audibility and also when in SKI MODE allows ease of pin-pointing the skis.

There are four operational MODES of the system each mode being enabled by the remote control unit. These modes being:

1: STANDBY
2: SKI
3: THEFT
4: TEST

1. STANDBY MODE indicates that the system status is operational and awaiting instructions.

2. SKI MODE, as previously described indicates the system is enabled to detect a lack of motion.

3. THEFT MODE, as previously described indicates the system is armed to detect motion.

4. TEST MODE, when enabled will provide a system verification including alarm function and battery condition.

To enable the above MODES the remote control is momentarily operated by squeezing the case. This in turn activates an internal switch and causes an encoded infra red transmission to be emitted. The chance of two identical codes being assigned to two transmitters is 1 in 4096 which are acceptable especially when weighting the chances of these two units being in the same place at any one time.

The concept of using an internal switch allows ease of operation when wearing mittens or gloves and also prevents accidental operation. In addition the cost effectiveness is increased due to the removal of the requirement for waterproofing seals.

The enablement procedure is as follows:

Enable SKI MODE press once.
Enable THEFT MODE press two times.
Enable TEST MODE press three times.
Reenable STANDBY MODE from any of above press once.

The system must always return to the STANDBY MODE prior to changing the MODE of operation. As each MODE is enabled the ski based alarms will momentarily sound at a reduced power level. Whilst both the ski based and remote control based LED lights will continually flash a coded sequence indicating visually the enabled MODE.

The remote control unit has a range of approximately 2 meters thus allowing ease of operation when the skis are either being worn or left alone.

As previously mentioned when enabling and during each MODE the S B U's (Ski Based Units) will indicate audibly that a new mode has just been enabled and visually (on both the S B U's and the remote control) on a continuous basis which mode is currently enabled. The visual status is shown by the LED's flashing the coded sequence set out below:

1. STANDBY MODE—no LED indication.
2. SKI MODE—1/20 second LED flash repeated at 1
3. THEFT MODE—1/20 second LED double flash repeated as above.
4. TEST MODE—LED shows continually until returned to STANDBY.

In order to activate the piezo alarm the following conditions must be satisfied:

1. SKI MODE

A (NORMAL PHASE)

A lack of motion for more than 40 seconds. This time delay is to allow for periods of inactivity such as waiting in lift lines etc. Should the alarm accidently sound due to the user remaining stationary for longer than the above time it may be cancelled simply by moving the ski or deactivating with the remote control.

B (RESCUE PHASE)

This is an automatic phase in the ski mode which the circuit assumes if the alarm has run for five minutes without being reset. In the rescue phase at this time the alarm is modified to sound only for a period of three seconds at one minute intervals. Typically, battery life can be ten hours in this phase.

2. THEFT MODE

Any motion causes an immediate alarm which continues only for the duration of the motion. internal timer is also activated by any motion. After 16 seconds, if there is still any motion, then the alarm will continue until there has been a lack of motion for a period of 16 seconds, at which time the mode is re-set.

3. TEST MODE

A test instruction from the transmitter will sound the alarm at a reduced power level until the STANDBY MODE is reenabled.

4. In addition, when any MODE is initially enabled the alarm will sound momentarily thus allowing the user easy confirmation of a MODE change.

The design of the case has been developed to minimize snow and ice build up and to complement the present ski binding designs in aesthetics.

The internal case design has been similarly developed in order to enhance the sound level emission.

The mounting of the S B U's is achieved by using two set hexagonal socket head screws per unit connecting the case via a rubber gasket to the ski. This method of mounting results in a deformation absorbent, water resistant seal which is required when considering the ski deformations locally during operation.

In order to achieve the correct degree of compression of the gasket, shouldered self tapping set screws are employed. Thus, after drilling a small pilot hole in the ski for each screw, the S B U is screwed down until the shoulder bottoms out on the ski face.

As a result of the above design simple, quick and easy fitting is ensured coupled with a strong, resilient and theft deterring device.

It is anticipated that the S B U's will be mounted either just before or just after the binding location, thus rendering them unexposed to a crossed ski situation and negating any effect upon the vibration characteristics of the ski.

It is also possible to modify the alarm unit described above to remove the ski mode and utilize only the theft alarm mode. Such an infra-red controlled theft-only unit can be made inexpensively and can be made to sound the alarm on detection of any required movement. For example, the unit can be used to detect burglars by the movement of doors or windows, or the theft of any article to which the alarm unit is fixed or is resting—e.g. bicycles, motorcycles, television sets etc. The above-described system for avoiding unnecessary alarms in the event of accidental movement is useful for such arrangements in which the alarm unit is fixed to the article to be protected. The delay time of 16 seconds can be changed to suit individual circumstances.

We claim:

1. An alarm unit for a ski, comprising:

a sounder for emitting an audible alarm signal;

a battery powered circuit means connected to said sounder for energizing said sounder; and a movement responsive means connected to said circuit means for detecting movement and providing an output representative of the movement;

wherein said circuit means has a timer arranged such that said circuit means can activate said sounder when said movement responsive means has provided no output representative of movement for a predetermined period of time; and wherein said circuit means further comprises a mode switching means for switching between at least two modes, a first of said modes being a ski mode wherein said sounder is activated in response to said movement responsive means providing no output representative of movement for said predetermined period of time and a second of said modes being a theft mode wherein said circuit activates said sounder in response to said movement responsive means detecting movement.

2. The alarm unit as set forth in claim 1, wherein:

said mode switching means can further switch between a test mode in which the alarm unit may be tested and a standby mode.

3. The alarm unit as set forth in claim 1 or 2, wherein:

said movement responsive means comprises a housing having a plurality of walls, a plurality of internal electrodes on different respective said walls of said housing, and a plurality of discrete electrically conductive members in said housing which are free to move within said housing, wherein said members are disposed in contact with each other and with said electrodes to form a conductive bridge between said electrodes and to establish an electrical resistance between said electrodes, and wherein movement of said members in said housing changes the electrical resistance between said internal electrodes.

4. The alarm unit as set forth in claim 3, wherein:

said members are metal balls.

5. The alarm unit as set forth in claim 4, wherein: said housing is oil filled.

6. The alarm unit as set forth in claim 3, wherein: said housing is oil filled.

7. The alarm unit as set forth in claim 1 or 2, wherein: said sounder produces a sound in the frequency range of 2000 to 4000 Hz when activated.

* * * * *